US012357108B2

(12) United States Patent
Hu

(10) Patent No.: US 12,357,108 B2
(45) Date of Patent: Jul. 15, 2025

(54) HIP CARRIER

(71) Applicant: Lianjun Hu, Rancho Cucamonga, CA (US)

(72) Inventor: Lianjun Hu, Rancho Cucamonga, CA (US)

( * ) Notice: Subject to any disclaimer, the term of this patent is extended or adjusted under 35 U.S.C. 154(b) by 195 days.

(21) Appl. No.: 18/474,642

(22) Filed: Sep. 26, 2023

(65) Prior Publication Data

US 2025/0098872 A1 Mar. 27, 2025

(51) Int. Cl.
*A47D 13/02* (2006.01)

(52) U.S. Cl.
CPC ..... *A47D 13/02* (2013.01); *A47D 13/025* (2013.01)

(58) Field of Classification Search
CPC ..... A47D 13/02; A47D 13/025
USPC ..... 224/159, 160; D3/213
See application file for complete search history.

(56) References Cited

U.S. PATENT DOCUMENTS 5,492,256 A * 2/1996 Ive ..... A47D 13/025 224/159
5,641,101 A * 6/1997 Nakayama ..... A47D 13/025 224/159
5,657,912 A * 8/1997 Nakayama ..... A45F 3/00 224/159
5,711,466 A * 1/1998 Kataoka ..... A47D 13/029 224/159
5,934,528 A * 8/1999 Higuchi ..... A47D 13/025 224/159
9,700,152 B2 * 7/2017 Telford ..... A47D 13/025
D976,012 S * 1/2023 Tsai ..... D6/333
D1,041,874 S * 9/2024 Ge ..... D3/214
2019/0350380 A1 * 11/2019 Tsai ..... A47D 13/025
2024/0099478 A1 * 3/2024 Xie ..... A47D 13/025
2025/0098872 A1 * 3/2025 Hu ..... A47D 13/025
2025/0143482 A1 * 5/2025 Cammarata ..... A47D 13/02

* cited by examiner

*Primary Examiner* — Justin M Larson
(74) *Attorney, Agent, or Firm* — Clement Cheng

(57) ABSTRACT

A hip carrier has a belt strap supporting a seat. The seat holds a seat insert which can be made of foam. The seat can be further supported by a shoulder retainer. The seat is mounted to the belt strap. The seat has a right strap connection and a left strap connection. A seat insert fits into a seat pad compartment. The shoulder retainer includes a left shoulder strap and a right shoulder strap connected together at a shoulder strap junction. A shoulder strap junction is formed as a shoulder retainer front panel. The right shoulder strap extends to a left rear shoulder strap, and the left shoulder strap extends to a right rear shoulder strap. The right rear shoulder strap crosses the left rear shoulder strap.

16 Claims, 6 Drawing Sheets

HIP CARRIER

TECHNICAL FIELD

The present invention is in the field of hip carriers.

BACKGROUND

A variety of different hip carriers have been implemented in the industry for providing hip carry of infants and toddlers. Some of these hip carriers have been described in the prior art. For example, U.S. Pat. No. 9,700,152, by inventor Telford issued Jul. 11, 2017 entitled Hip Seat Device And System, the inventor discloses a hip seat for carrying a child, the disclosure of which is incorporated herein by reference.

SUMMARY OF THE INVENTION

A hip carrier has a belt strap supporting a seat. The seat holds a seat insert which can be made of foam. The seat can be further supported by a shoulder retainer. The seat is mounted to the belt strap. The seat has a right strap connection and a left strap connection. A seat insert fits into a seat pad compartment. The shoulder retainer includes a left shoulder strap and a right shoulder strap connected together at a shoulder strap junction. A shoulder strap junction is formed as a shoulder retainer front panel. The right shoulder strap extends to a left rear shoulder strap, and the left shoulder strap extends to a right rear shoulder strap. The right rear shoulder strap crosses the left rear shoulder strap. The left rear shoulder strap extends to a left seat strap that connects to the left strap connection. The right rear shoulder strap extends to a right seat strap that connects to the right strap connection.

The hip carrier optionally includes a belt bag mounted to the belt strap. The hip carrier may also include a front seat compartment formed on the seat.

The seat further includes a right front seat sleeve pocket. The right front seat sleeve pocket covers the right strap connection and the seat further includes a left front seat sleeve pocket. The left front seat sleeve pocket covers the left strap connection. The seat further includes a seat pad flap. The shoulder retainer front panel extends downwardly to a shoulder retainer flap. The shoulder retainer flap connects to the seat pad flap. A right upper buckle and a left upper buckle are connected to the shoulder retainer flap. A right lower buckle and a left lower buckle are connected to the seat pad flap. The right upper buckle engages the right lower buckle and the left upper buckle engages the left lower buckle.

The left seat strap terminates at a left outer connector, and the right seat strap terminates at a right outer connector. The left strap connection is formed as a left inner connector. The right strap connection is formed as a right inner connector, and the left outer connector attaches to the left inner connector. The right outer connector attaches to the right inner connector.

The right outer connector and the left outer connector have a locking head channel. The right inner connector and the left inner connector have a protrusion head. The protrusion head engages the locking head channel.

The protrusion head has a protrusion head mesa. The locking head channel is formed as a leaf spring biasing towards the protrusion head mesa and the locking head channel also has a mesa locking indent. The outer connector is formed as a locking head and the locking head has a locking head base surface. The inner connector includes a protrusion base, and the locking head base surface engages a protrusion base retaining surface. The connection protrusion head is mounted to the protrusion base at an inner connector stem.

The following call out list of elements can be a useful guide in referencing the element numbers of the drawings.

The following call out list of elements can be a useful guide in referencing the element numbers of the drawings.

20 Shoulder Retainer
21 Left Shoulder Strap
22 Right Rear Shoulder Strap
23 Right Shoulder Strap
24 Shoulder Retainer Front Panel
25 Left Rear Shoulder Strap
26 Left Seat Strap
27 Right Seat Strap
28 Shoulder Retainer Flap
29 Shoulder Strap Junction
30 Seat
31 Seat Pad
32 Front Seat Compartment
33 Front Seat Compartment Zipper
34 Front Seat Sleeve Pocket
35 Right Strap Connection
36 Left Strap Connection
37 Seat Pad Compartment
38 Seat Pad Flap
39 Seat Sidewall
40 Belt Strap
41 Belt Bag
142 Belt Bag Zipper
42 Left Upper Buckle
143 Belt Bag Zipper Pull
43 Left Lower Buckle
44 Right Upper Buckle
45 Right Lower Buckle
46 Rear Crossover
47 Strap Connection Cover
48 Strap Connection Cover Cinch
49 Strap Connection Cover Pocket
150 Seat Insert
50 Connection Area
151 Foam Body
51 Connection Protrusion
152 Insert Front Surface

52 Protrusion Base
153 Insert Left Side Wall
53 Locking Head
154 Upper Insert Surface
54 Latch Release
254 Locking Head Buckle
55 Seat Strap Pull
58 Insert Tapered Bottom
70 Outer Connector
71 Locking Head Channel
72 Mesa Locking Indent
73 Forward Indent
74 Channel Bevel
75 Engaging Groove
76 Locking Head Base Surface
77 First Channel Sidewall
78 Second Channel Sidewall
79 Tactile Indent
80 Inner Connector
81 Inner Connector Stem
82 Base Stitching
83 Connection Protrusion Head
84 Protrusion Head Mesa
85 Protrusion Head Top Surface
86 Mesa Edge
87 Protrusion Head Edge
88 Protrusion Base Retaining Surface
89 Base Edge
91 Seat Right End
92 Seat Left End

DETAILED DESCRIPTION OF THE EMBODIMENTS

Figure 1:
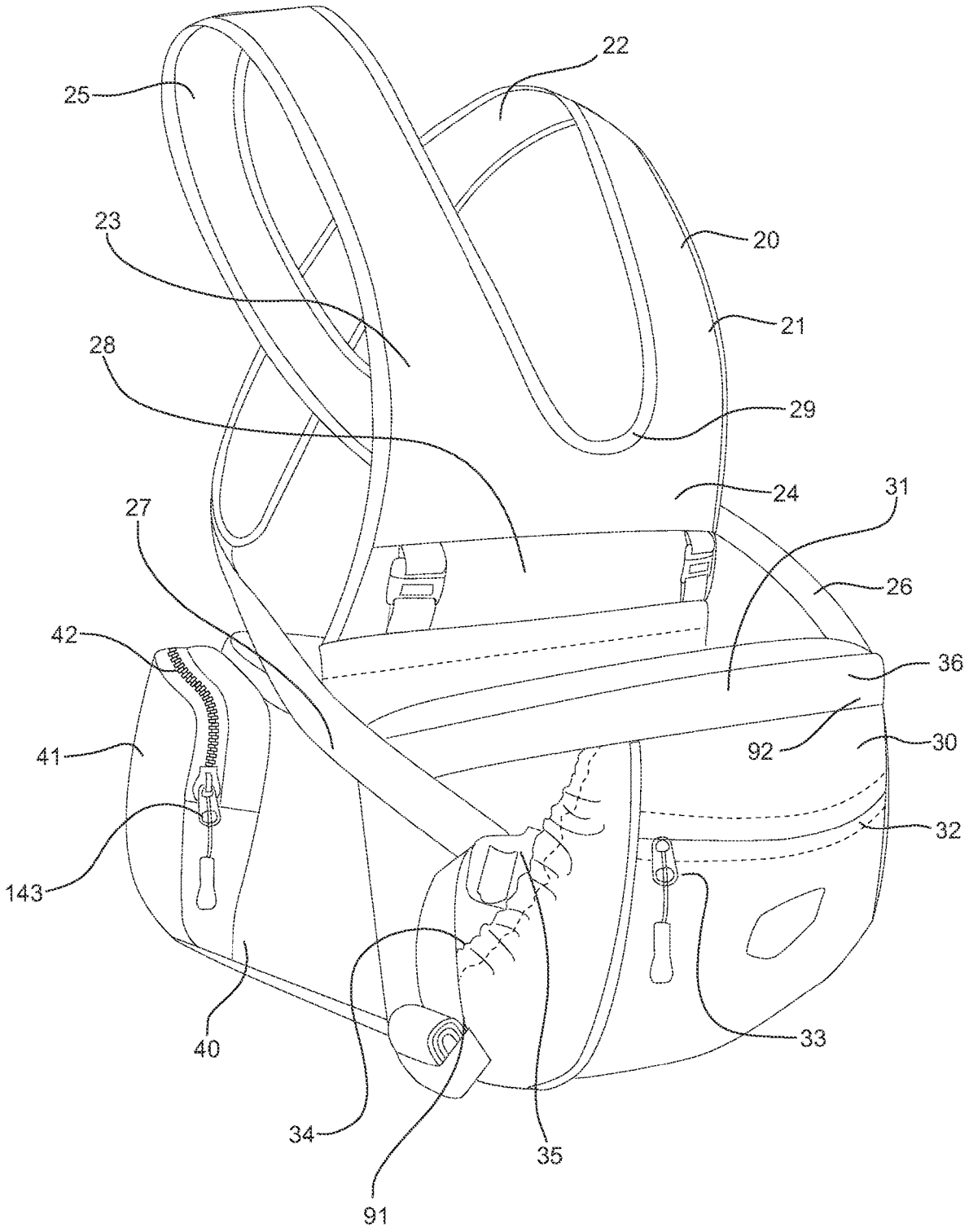
FIG. 1 is a left front perspective view of the present invention.

As shown in FIG. 1, the hip carrier includes a belt strap 40 that secures and supports a seat 30 for a small human passenger such as a toddler or infant. The seat 30 preferably has a seat pad 31 which forms a surface for a toddler or infant to sit on. Preferably, the seat 30 has a front seat compartment 32. The front seat compartment 32 can be a zippered compartment having a front seat compartment zipper 33. The front seat compartment zipper 33 has a front seat sleeve pocket 34. The right strap connection 35 is preferably in the front seat sleeve pocket 34. The right strap connection and the left strap connection are at ends of the seat rather than on the front of the seat as seen in the prior art. The side connections are designed to provide seating with the infant or toddler passenger not secured and would require a user to hold the passenger. This has the drawback of less security with increased convenience in situations where the passenger is constantly getting off and on the seat such as at an amusement park for example. The seat is formed as an elongated wedge shaped member with a right end and a left end. The strap connections are mounted on the seat right end 91 and the seat left end 92.

During light usage, such as for a new infant, the belt strap 40 is sufficient to support the seat 30 without a shoulder retainer 20. The belt strap 40 has a belt bag 41 that can have a zippered compartment at a belt bag zipper 142. The belt bag zipper 142 can have a belt bag zipper pull 143 so that a user can grasp the zipper beginning toward the front and pull it toward the back.

During heavier usage, the user can supplement the optional shoulder retainer 20. The shoulder retainer 20 has a left shoulder strap 21 and a right shoulder strap 23 joining at a shoulder strap junction 29. The shoulder strap junction 29 forms a shoulder retainer front panel 24 at an area lower than the shoulder strap junction 29. The shoulder retainer front panel 24 extends to a shoulder retainer flap 28 which connects to the seat 30 at buckles. The right shoulder strap 23 extends rearwardly to a left rear shoulder strap 25 while the left shoulder strap 21 extends rearwardly to a right rear shoulder strap 22. The right rear shoulder strap 22 connects to a right seat strap 27 which attaches at a right strap connection 35 on the seat 30. Similarly, the left rear shoulder strap 25 connects to a left seat strap 26 which connects to the seat 30 at the left strap connection 36. The left strap connection 36 and the right strap connection 35 can be mounted inside front seat sleeve pockets 34 such that extra slack line of the right seat strap 27 and the left seat strap 26 can be rolled up and stuffed into the front seat sleeve pockets. The front seat sleeve pocket can communicate from one side of the seat 32 the other side of the seat 30 for additional item storage.

Figure 2:
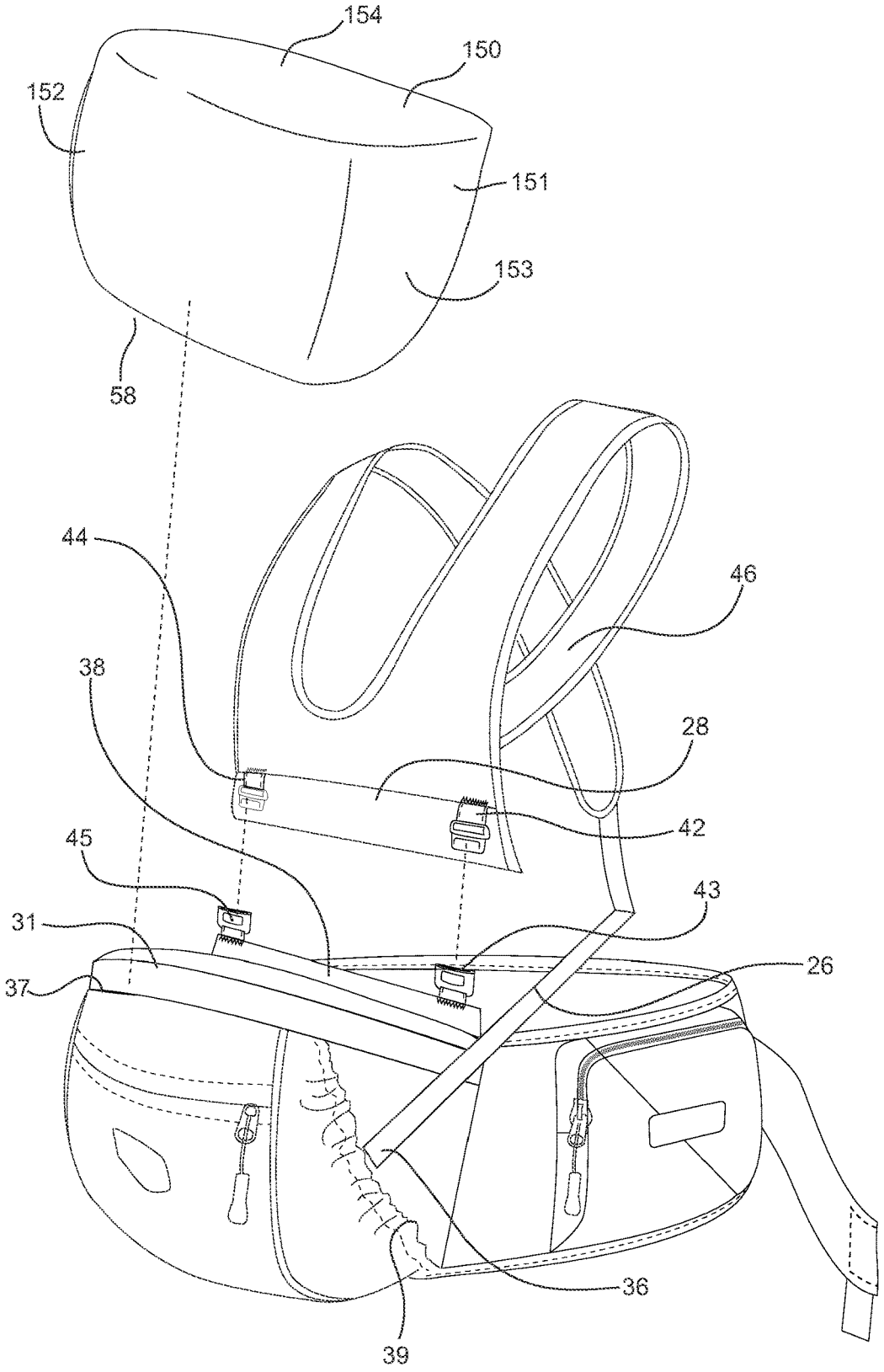
FIG. 2 is a right front perspective exploded view of the present invention.

As shown in FIG. 2, the hip carrier is modular and an additionally includes a seat insert 150 with a foam body 151. The foam body 151 has an insert left side wall 153 and an insert front surface 152. The insert left side wall 153 meets with the insert front surface 152 at an insert tapered bottom 58. The seat insert 50 also has an upper insert surface 154 which can support a passenger. The shoulder retainer 20 is formed as a shoulder harness having a rear crossover 46. The front of the shoulder retainer includes a left upper buckle 42 which connects to a left lower buckle 43 and also a right upper buckle 44 which connects to a right lower buckle 45. The shoulder retainer flap 28 forms a panel for retaining the left upper buckle 42 and the right upper buckle 44. A seat pad flap 38 extends upwardly from the seat 30. The seat pad flap 38 is connected to the left lower buckle 43 and the right lower buckle 45. Using the buckle system, the seat pad flap 38 connects to the shoulder retainer flap 28 by a dual buckle system which secures the shoulder retainer 22 the seat 30.

The left seat strap 26 connects to the left strap connection 36 on the seat sidewall 39. The left strap connection 36 is preferably in the front seat sleeve pocket 34 when the pocket fabric is covering the left strap connection 36. During use, a user can pull back the pocket to expose the left strap connection 36 as seen in FIG. 2. The seat pad 31 angles toward the user so that the passenger is biased toward the user. The seat pad 31 can have a seat pad compartment 37 which retains the seat insert 150. When a user is not using the seat insert 150, the seat insert 150 can be removed from the seat pad compartment 37 so that a user can carry articles instead of a passenger. Therefore, the seat 30 has a modular configuration allowing different modes of operation which include a passenger mode and a cargo mode. The user can convert the seat 30 into cargo mode when the user has articles to carry.

Figure 3:
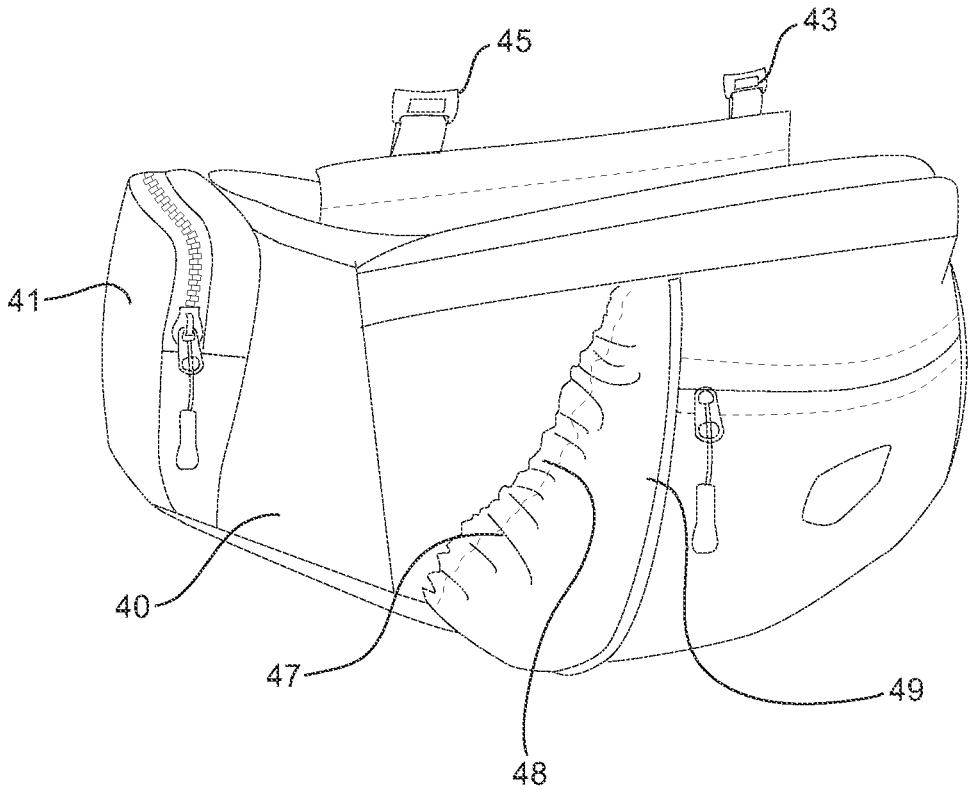
FIG. 3 is a right front perspective view of the belt strap portion.
Figure 4:
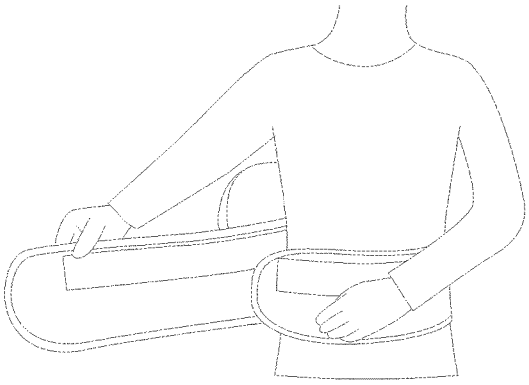
FIGS. 4-7 are diagrams showing a person putting on the present invention.
Figure 5:
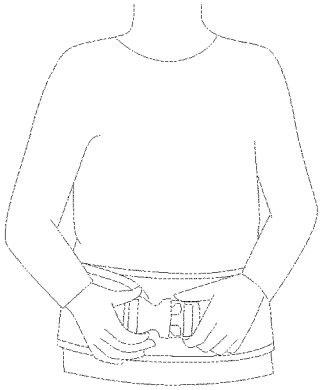
Figure 6:
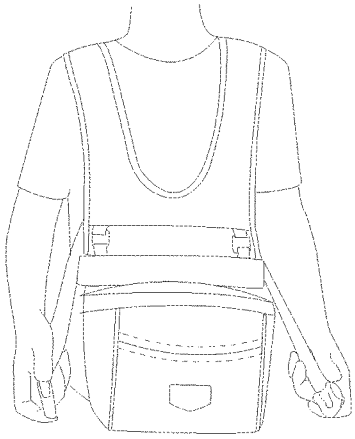
Figure 7:
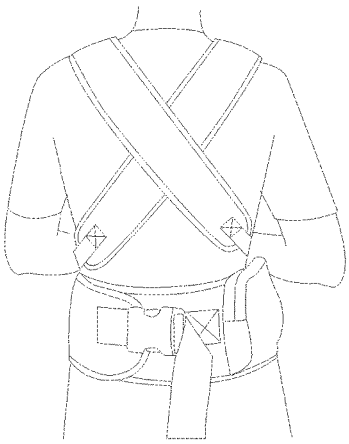

As shown in FIG. 3, the belt strap 40 can be worn by itself. The belt strap 40 has a belt bag 41 on a right side or a left side. The belt strap 40 has a left lower buckle 43 and a right lower buckle 45. The belt strap 40 extends to the seat 30 and the seat has a strap connection cover 47 that closes at an elastic strap connection cover cinch 48. The strap connection cover 47 is loose and can provide a strap connection cover pocket 49. The strap connection cover pocket 49 can cover the left strap connection 36 for example.

As shown in FIGS. 4-7, the user first puts on the belt, then attaches the belt buckle to secure the belt. The belt may have a hook and loop tape for additional security. The user can then attach the shoulder harness and tighten the straps. The user can then adjust the pull straps for comfort.

Figure 8:
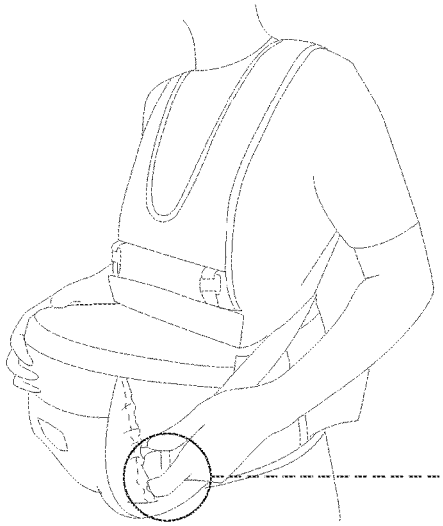
FIG. 8 is a diagram showing a user attaching the shoulder strap to the seat.
Figure 9:
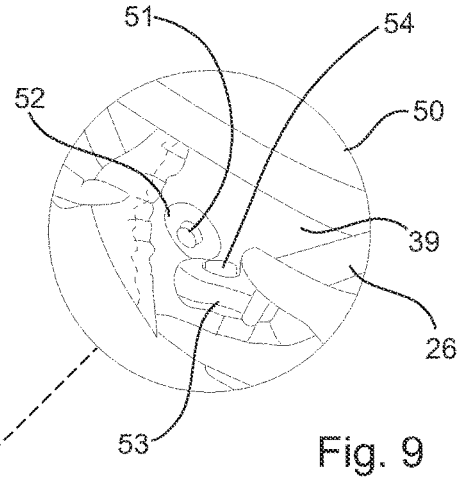
FIG. 9 is a diagram showing a user aligning the locking head to the connection protrusion.
Figure 10:
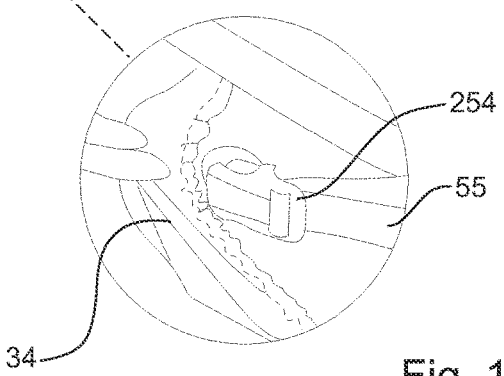
FIG. 10 is a diagram showing a user putting the locking head over the connection protrusion.

As shown in FIGS. 8-10, the user can make a connection at the connection area 50. The connection protrusion 51 has a protrusion base 52. The protrusion base 52 is stitched to the seat sidewall 39 of the seat 30. The left seat strap 26 extends to a locking head 53 that connects to the connection protrusion 51. The connection area 50 is on the left and right of the seat. The locking head 53 has a latch release 54 which allows detaching the locking head 53 from the connection protrusion 51. The locking head 53 can then be covered by the front seat sleeve pocket 34. The locking head buckle 254 can allow a seat strap pull 55 to extend from the locking head buckle 254 such that a user can pull on the seat strap pull 55 to tighten the left seat strap 26.

Figure 11:
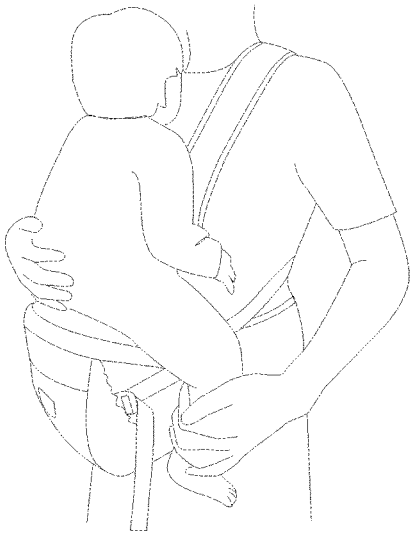
FIG. 11 is a figure of a baby on the seat.
Figure 12:
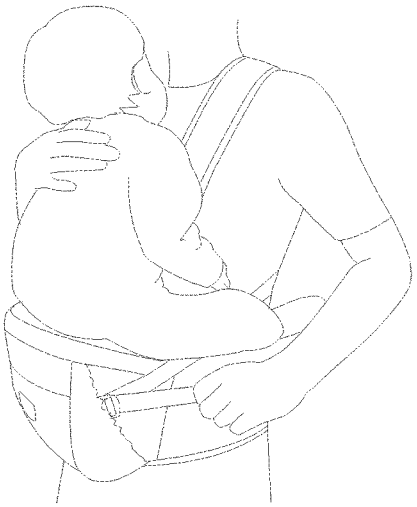
FIG. 12 is a figure of a baby on the seat with the user pulling on the seat strap pull.

As shown in FIGS. 11-12, the passenger has legs that can rest over the seat straps.

Figure 13:
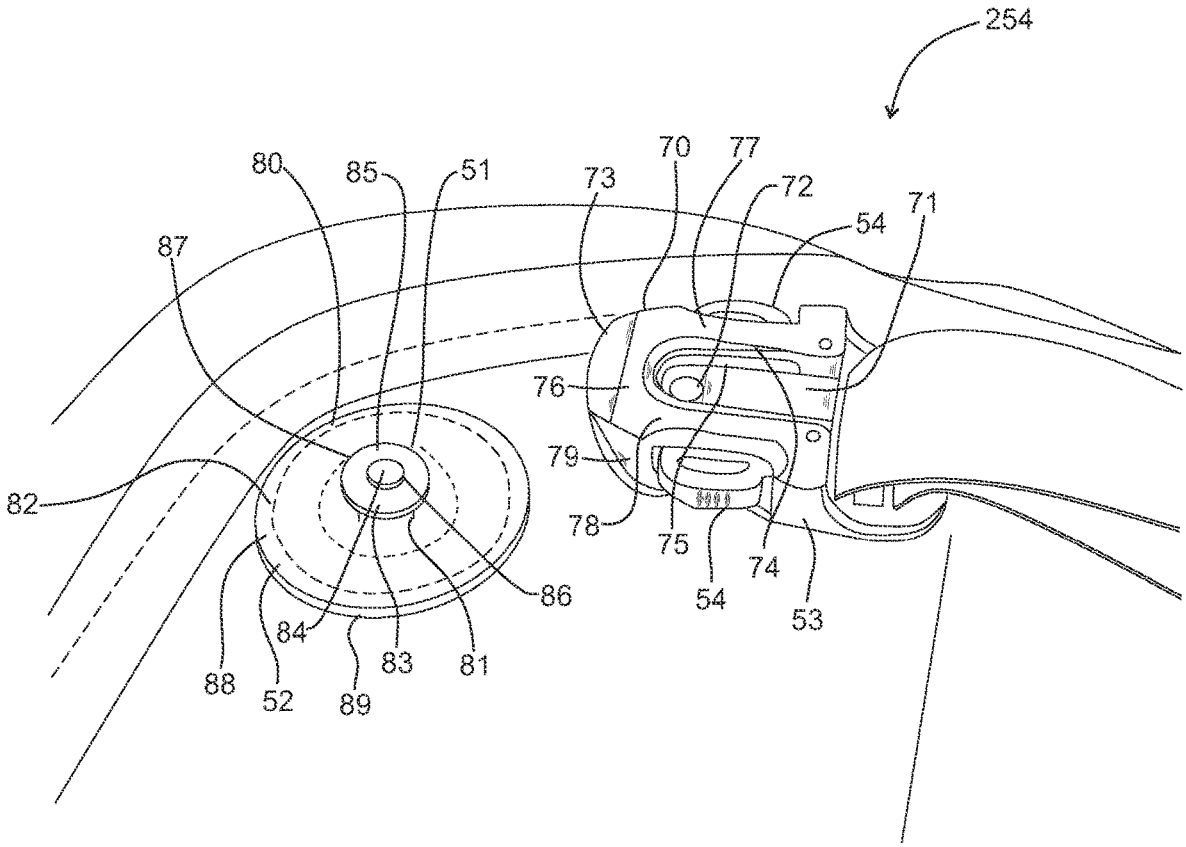
FIG. 13 is a diagram showing a strap connection.

As shown in FIG. 13, and the connection protrusion 51 has a protrusion base 52. The protrusion base 52 has a base stitching 82 preferably formed as concentric rings of stitching that circumscribe the connection protrusion 51. The protrusion base 52 can be formed as a flat plastic or fabric member that allows stitching or thermoplastic lamination to the substrate. The base stitching 82 can be formed as a pair of concentric circles for example. The protrusion base 52 has a protrusion base retaining surface 88 that receives an underside of the locking head buckle 254. A locking head 53 has a locking head base surface 76 that rides over and abuts the protrusion base retaining surface 88. The protrusion base retaining surface 88 can be a leathery material that has compressive flexibility biasing against the locking head base surface 76.

The connection protrusion 51 further includes a circular or disk shaped connection protrusion head 83 having a circular or disk shaped protrusion head mesa 84 extending from the connection protrusion head 83. The connection protrusion head 83 extends from the protrusion base 52 at an inner connector stem 81. The inner connector stem 81 passes between the first channel sidewall 77 and the second channel sidewall 78 when the connection protrusion 51 engages the locking head 53 in an engaged position from a disengaged position.

The outer connector 70 is preferably formed as the locking head 53. The outer connector 70 preferably further includes a forward indent 73. The forward indent 73 is preferably a beveled surface. The locking head base surface 76 is preferably U-shaped for receiving the connection protrusion 51. The protrusion head mesa 84 lodges in the mesa locking indent 72. The locking head channel 71 is formed as a leaf spring that biases the mesa locking indent 72 against the protrusion head mesa 84. When the user presses the latch release 54, the locking head channel 71 is pulled away from the protrusion head mesa 84 to allow release of the outer connector 70 from the inner connector 80. The connection protrusion head 83 has a protrusion head edge 87 that engages an engaging groove 75 of the locking head 53. The protrusion head mesa 84 has a mesa edge 86 that engages a mesa locking indent 72 of the outer connector 70, when in the engaged position. The base edge 89 does not catch on the locking head 53 due to the forward indent 73. A user can slide the forward indent 73 over the base edge 89 until the protrusion head edge 87 rides over a channel bevel 74. The channel bevel 74 is U-shaped and guides the connection protrusion head 83 into the locking head channel 71. The second channel sidewall 78 and the first channel sidewall 77 bound the left and right sides of the locking head channel 71.

The invention claimed is:

1. A hip carrier comprising:

a. a belt strap;

b. a seat, wherein the seat is mounted to the belt strap, wherein the seat has a right strap connection mounted on a seat right end and a left strap connection mounted on a seat left end;

c. a seat insert, wherein the seat insert fits into a seat pad compartment; and d. a shoulder retainer, wherein the shoulder retainer includes a left shoulder strap and a right shoulder strap connected together at a shoulder strap junction, wherein the shoulder strap junction is formed as a shoulder retainer front panel, wherein the right shoulder strap extends to a left rear shoulder strap, and wherein the left shoulder strap extends to a right rear shoulder strap, wherein the right rear shoulder strap crosses the left rear shoulder strap, wherein the left rear shoulder strap extends to a left seat strap that connects to the left strap connection, wherein the right rear shoulder strap extends to a right seat strap that connects to the right strap connection.

2. The hip carrier of claim 1, wherein the hip carrier further includes a belt bag mounted to the belt strap.

3. The hip carrier of claim 1, wherein the hip carrier further includes a front seat compartment formed on the seat.

4. The hip carrier of claim 1, wherein the seat further includes a right front seat sleeve pocket, wherein the right front seat sleeve pocket covers the right strap connection and wherein the seat further includes a left front seat sleeve pocket, wherein the left front seat sleeve pocket covers the left strap connection.

5. The hip carrier of claim 1, wherein the seat further includes a seat pad flap, wherein the shoulder retainer front panel extends downwardly to a shoulder retainer flap, wherein the shoulder retainer flap connects to the seat pad flap.

6. The hip carrier of claim 5, further including a right upper buckle and a left upper buckle connected to the shoulder retainer flap, and further including a right lower buckle and a left lower buckle connected to the seat pad flap, wherein the right upper buckle engages the right lower buckle and wherein the left upper buckle engages the left lower buckle.

7. The hip carrier of claim 1, wherein the left seat strap terminates at a left outer connector, and wherein the right seat strap terminates at a right outer connector, wherein the left strap connection is formed as a left inner connector, wherein the right strap connection is formed as a right inner connector, wherein the left outer connector attaches to the left inner connector, and wherein the right outer connector attaches to the right inner connector.

8. The hip carrier of claim 7, wherein the right outer connector and the left outer connector have a locking head channel, wherein the right inner connector and the left inner connector have a protrusion head, wherein the protrusion head engages the locking head channel.

9. The hip carrier of claim 8, Wherein the protrusion head further includes a protrusion head mesa, wherein the locking head channel is formed as a leaf spring and further includes a mesa locking indent, wherein the mesa locking indent engages the protrusion head mesa, wherein the locking head channel is formed between a first channel sidewall and a second channel sidewall.

10. The hip carrier of claim 9, further including an engaging groove, wherein the engaging groove receives the protrusion head edge.

11. The hip carrier of claim 10, wherein the outer connector is formed as a locking head, wherein the locking head has a locking head base surface, wherein the inner connector includes a protrusion base, wherein the locking head base surface engages a protrusion base retaining surface, wherein the connection protrusion head is mounted to the protrusion base at an inner connector stem.

12. The hip carrier of claim 11, wherein the hip carrier further includes a belt bag mounted to the belt strap.

13. The hip carrier of claim 11, wherein the hip carrier further includes a front seat compartment formed on the seat.

14. The hip carrier of claim 11, wherein the seat further includes a right front seat sleeve pocket, wherein the right front seat sleeve pocket covers the right strap connection and wherein the seat further includes a left front seat sleeve pocket, wherein the left front seat sleeve pocket covers the left strap connection.

15. The hip carrier of claim 11, wherein the seat further includes a seat pad flap, wherein the shoulder retainer front panel extends downwardly to a shoulder retainer flap, wherein the shoulder retainer flap connects to the seat pad flap.

16. The hip carrier of claim 15, further including a right upper buckle and a left upper buckle connected to the shoulder retainer flap, and further including a right lower buckle and a left lower buckle connected to the seat pad flap, wherein the right upper buckle engages the right lower buckle and wherein the left upper buckle engages the left lower buckle.

* * * * *